US006283436B1

(12) United States Patent
Schulz et al.

(10) Patent No.: US 6,283,436 B1
(45) Date of Patent: Sep. 4, 2001

(54) CHRISTMAS TREE STAND

(75) Inventors: Farriba Schulz; Rainer Schulz, both of Munich (DE)

(73) Assignee: Klauss Krinner, Strasskrichen (DE)

( * ) Notice: Subject to any disclaimer, the term of this patent is extended or adjusted under 35 U.S.C. 154(b) by 0 days.

(21) Appl. No.: 09/403,457

(22) PCT Filed: Apr. 28, 1998

(86) PCT No.: PCT/EP98/02508

§ 371 Date: Jul. 13, 2000

§ 102(e) Date: Jul. 13, 2000

(87) PCT Pub. No.: WO98/48678

PCT Pub. Date: Nov. 5, 1998

(30) Foreign Application Priority Data

Apr. 28, 1997 (DE) ..... 297 07 643 U

(51) Int. Cl.[7] ..... F16M 13/00
(52) U.S. Cl. ..... 248/523
(58) Field of Search ..... 248/519, 523, 248/524, 525, 526

(56) References Cited

U.S. PATENT DOCUMENTS

| | | | | |
|---|---|---|---|---|
| 5,114,113 | * | 5/1992 | Krinner | 248/525 |
| 5,797,579 | * | 8/1998 | Krinner | 248/523 |
| 6,019,341 | * | 2/2000 | Brown et al. | 248/525 X |
| 6,087,946 | * | 7/2000 | Menard, Jr. | 340/618 |
| 6,094,859 | * | 8/2000 | Kalman et al. | 248/525 X |

* cited by examiner

*Primary Examiner*—Ramon O. Ramirez
(74) *Attorney, Agent, or Firm*—Jordan and Hamburg LLP

(57) ABSTRACT

A mechanical holder is disclosed for holding Christmas trees of various sizes and trunk shapes. The holder includes a base, a vessel fixed to the base and provided with a centering spike, and several retaining elements regularly spaced apart around the vessel. In their retaining position above the vessel, the retaining elements can swivel independently of each other to align and retain the Christmas tree with their faces towards the axis of symmetry. According to the invention, the Christmas tree stand has a single tensioning device which applies to the tree trunk the force required to align and retain the tree. Through the action of several force transmitting elements and diverting elements, the retaining elements compensate for possible irregularities or slanted tree growth.

21 Claims, 3 Drawing Sheets

CHRISTMAS TREE STAND

BACKGROUND OF THE INVENTION

The invention relates to a retaining device for receiving Christmas trees of various sizes and trunk shapes.

A wide range of different designs for Christmas tree stands are known in practice. There are stands available which comprise a base plate and a tube which is fastened vertically thereon and in which the Christmas tree is fastened by means of a plurality of horizontally arranged T-screws. Erecting a tree using such stands usually involves a number of problems: two people are required in order to erect and align the tree; the tree trunks usually have to be adapted to the tree stand; the T-screws only provide small grip surfaces for fingers and are thus difficult to rotate; and only a small water supply, if any at all, is ensured.

Also known are stands wherein the receiving tube has an oversized diameter and in which the tree is positioned approximately centrally and wedged firmly by means of a plurality of wedges, which are driven between the border of the receiving tube and the tree. It is also difficult in this case for a single person to align the tree.

Also known is a stand in which the tree trunk to be fastened is guided in a sleeve provided with slots. A wedge-shaped displacement body in the form of a union nut is screwed onto the outer circumference of the sleeve and, by virtue of its wedge-shaped displacement profile, displaces radially arranged pressing jaws in the direction of the tree trunk. The tree trunk guided in the sleeve is finally clamped in and fixed by the radially inwardly moving pressing jaws. It is also disadvantageous in the case of this tree stand that, if the cross section of the tree trunk is not circular, then nonuniform abutment of the pressing jaws results and causes insufficient fastening and alignment of the tree which is not completely vertical.

Also known are Christmas tree stands having a trunk-receiving part arranged on the base plate, and a plurality of retaining elements which are arranged about an axis of symmetry and can be pivoted individually, independently of one another, above the receiving part between a release position and a retaining position in planes which intersect at least more or less in the axis of symmetry. In the retaining position, the retaining elements can be made to butt under pressure against the trunk of the Christmas tree by way of an abutment region and have just one tensioning device which, via one force transmitting element, acts with the same force on all the retaining elements simultaneously and moves the retaining elements into their retaining position. This stand, which has achieved considerable market penetration, seems to be the best one at present. However, this Christmas tree stand also has disadvantages: it is necessary, in order to actuate the tensioning device, to produce a considerable manual force when one is bent down to a considerable extent, a position in which it is difficult to keep the tree straight. A cable, for example, a steel cable, which is pulled by the tensioning device and makes the retaining elements butt against the tree trunk, operates on two considerably different planes, develops, at the furthest point from the tensioning device, i.e., on the rear retaining elements, a considerable tensile force that does not allow uniform force distribution over all the retaining elements. An extremely stable construction of the stand is required that is very cost-intensive.

Also known is a Christmas tree stand which is produced by complex and expensive casting and is designed as a pot with three fixed crosspieces at spacings of 120° and an inclination of 25° in a slanting plane. Clamping wedges provided with corresponding grooves are arranged such that the wedges are movable on the crosspieces such that the tree is centrally positioned and presses on a plate connected to the clamping wedges and thus makes the clamping wedges butt against the tree and fasten it. A tree that is fastened in this way is difficult to remove again.

SUMMARY OF THE INVENTION

The object of the present invention is to provide a mechanical retaining device of a generic type by means of which Christmas trees of a height of up to approximately 2.50 m, with thick or thin trunks and a smooth or non-uniform trunk surface are uniformly fastened and automatically aligned in the vertical position with the smallest possible amount of force being exerted.

This object is achieved according to the present invention in that two or more flexible connections are directed from a fixation point and are arranged in a tiltable and rotatable manner, via a plurality of retaining elements, by way of a diverting element that guides the flexible connections to a pulling element. The flexible connections are tensioned by the pulling element such that the retaining elements, which are arranged in a tiltable manner, move, by way of their top outer ends, in a predetermined radius in relation to an axis of symmetry of the receiving vessel, which receives the tree trunk, and arrest the latter. The fixation point is in a plane that is lower than the retaining elements. The flexible connections are crossed with one another between the pulling element and the retaining elements and are crossed with one another between the retaining elements and end fastening points. Upon tensioning of the flexible connections, the retaining elements butt against the tree trunk by means of the pulling element in a flexible manner. Accordingly, the flexible connections compensate for unevenness in the shape of the tree trunk without the loss of force due to the movability of the fixation point.

The straightforward operation of the pulling element, either by actuating a foot lever or a remote control means which sets an electric motor in operation, makes it possible to erect the tree reliably and vertically in relation to its axis of symmetry without one being forced to bend down.

DETAILED DESCRIPTION OF THE INVENTION

Figure 1:
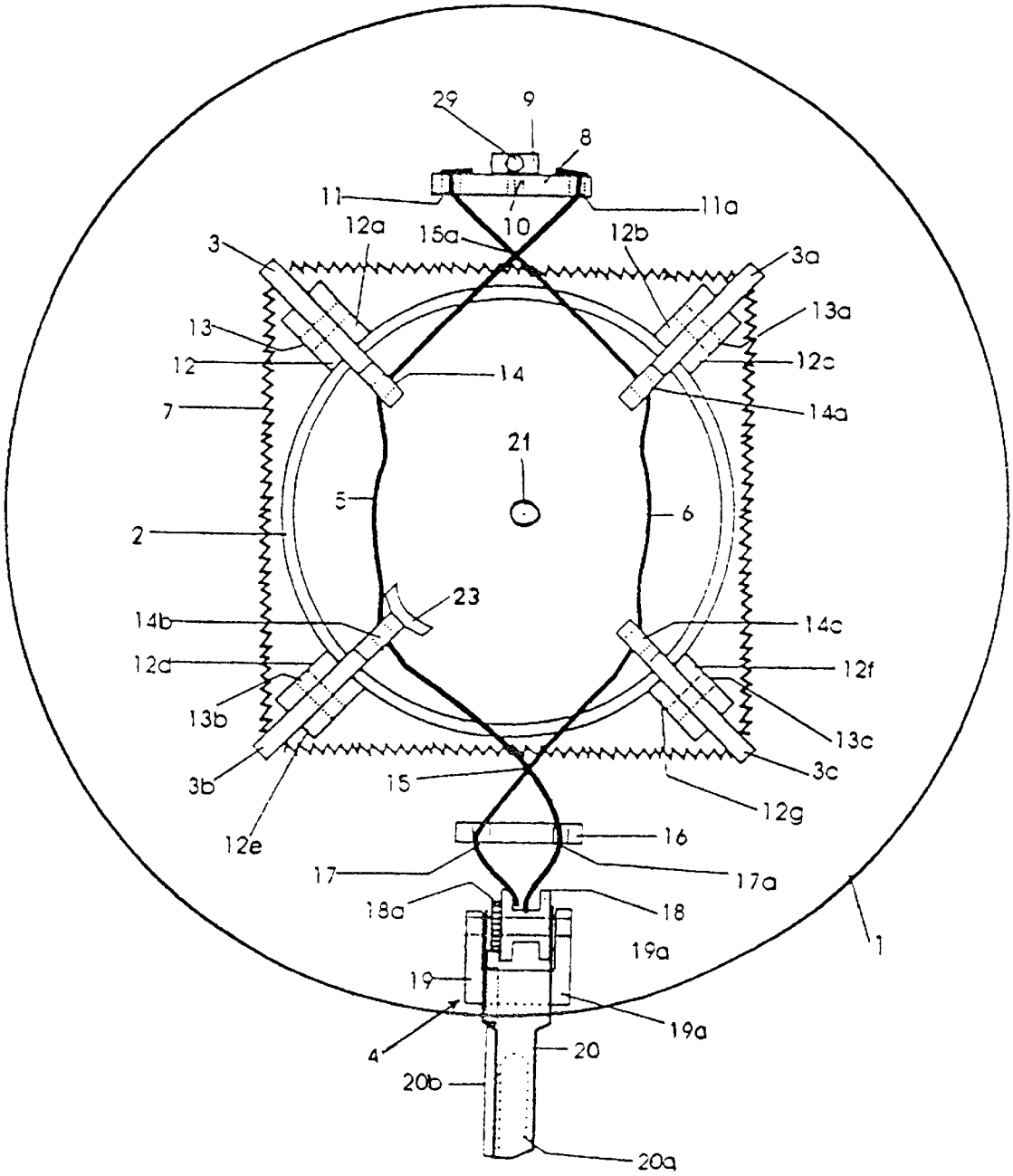
FIG. 1 schematic plan view of a Christmas tree stand of the present invention during functioning with two flexible connections.

A base plate 1 according to FIG. 1 has fixed to it a receiving vessel 2, which may be cylindrical or, in order to provide a greater water supply, polygonal, and serves for fixing and watering a Christmas tree. A spike 21 is provided centrally within the receiving vessel 2 in order to fix the tree trunk.

In order for the retaining elements 3, 3*a*, 3*b* and 3*c*, that are arranged at regular intervals around the receiving vessel 2 on bearing bolts 13, 13*a*, 13*b* and 13*c* such that they can be pivoted in or on bearing blocks 12, 12*a*, 12*b*, 12*c*, 12*d*, 12*e*, 12*f* and 12*g*, to be transferred from their rest position, which is brought about by one or more restoring springs 7 directed by guide grooves 22 and 22*a*, into a retaining position, use is made of a commercially available ratchet 18. The ratchet 18 is mounted in a block 19 and 19*a* that is fixed to the base plate 1. The ratchet rolls up flexible connections 5 and 6 by means of vertical pressure-induced movement of a lever 20, which has a polygonal or round hollowed-out formation 20*a* in order to receive a lever extension 24 and 25. These connections 5 and 6 are guided through openings 17 and 17*a* and are guided through a diverting element 16 which is fixed to the base plate 1. The flexible connections 5 and 6 are crossed at location 15. The connections 5 and 6 then run through guides 14, 14*a*, 14*b* and 14*c* in the retaining elements 3, 3*a*, 3*b* and 3*c* and the flexible connections 5 and 6 are then crossed with respect to one another again, at location 15*a*, and are guided to their end points 11 and 11*a* in or on tiltable fastening element 8. The fastening element 8 is provided with a bearing bolt 10, on or in a bearing block 9, which is mounted rotatably on a spacer bolt 29.

By virtue of the diverting element 16 and the fastening elements 8 and 9 which are fixed to the base plate 1 and are in a lower plane than the retaining elements 3, 3*a*, 3*b* and 3*c*, the crossed arrangements 15 and 15*a* of the flexible connections 5 and 6 bring about—with only a small amount of force being exerted by tensioning device 4—very direct and nevertheless flexible tensile behavior of the flexible connections 5 and 6. By virtue of this and of the sliding freedom of movement which the flexible connections 5 and 6 have in the guide bores 14, 14*a*, 14*b* and 14*c*, the retaining elements 3, 3*a*, 3*b* and 3*c* provide the required uneven pressure against the trunk and accommodate for a tree which grew at a slant with respect to the trunk. Accordingly, the tree trunk is aligned and fastened in a predetermined vertical position.

Figure 2:
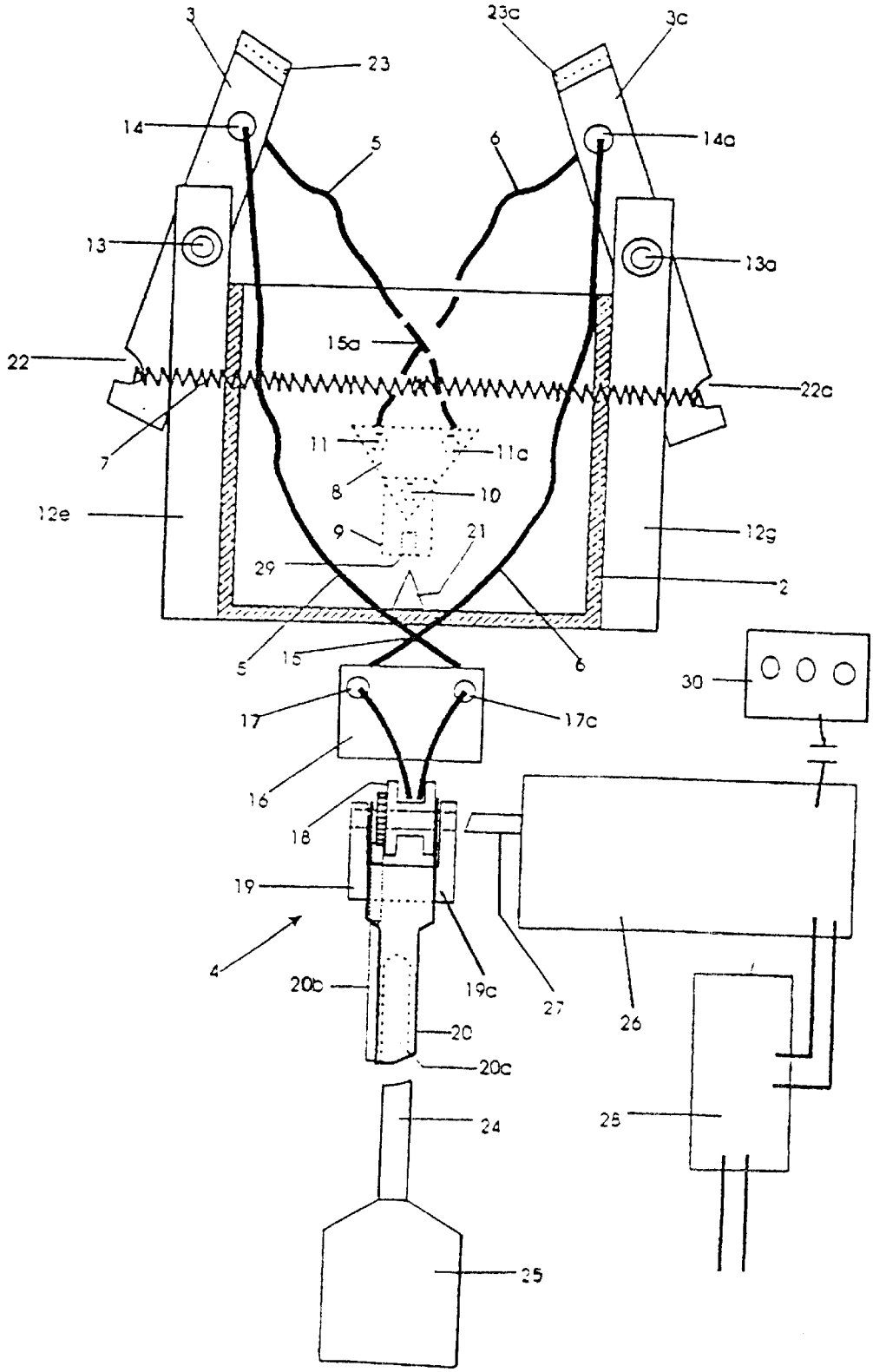
FIG. 2 schematic sectional illustration during functioning of the Christmas tree stand with two flexible connections.
Figure 3:
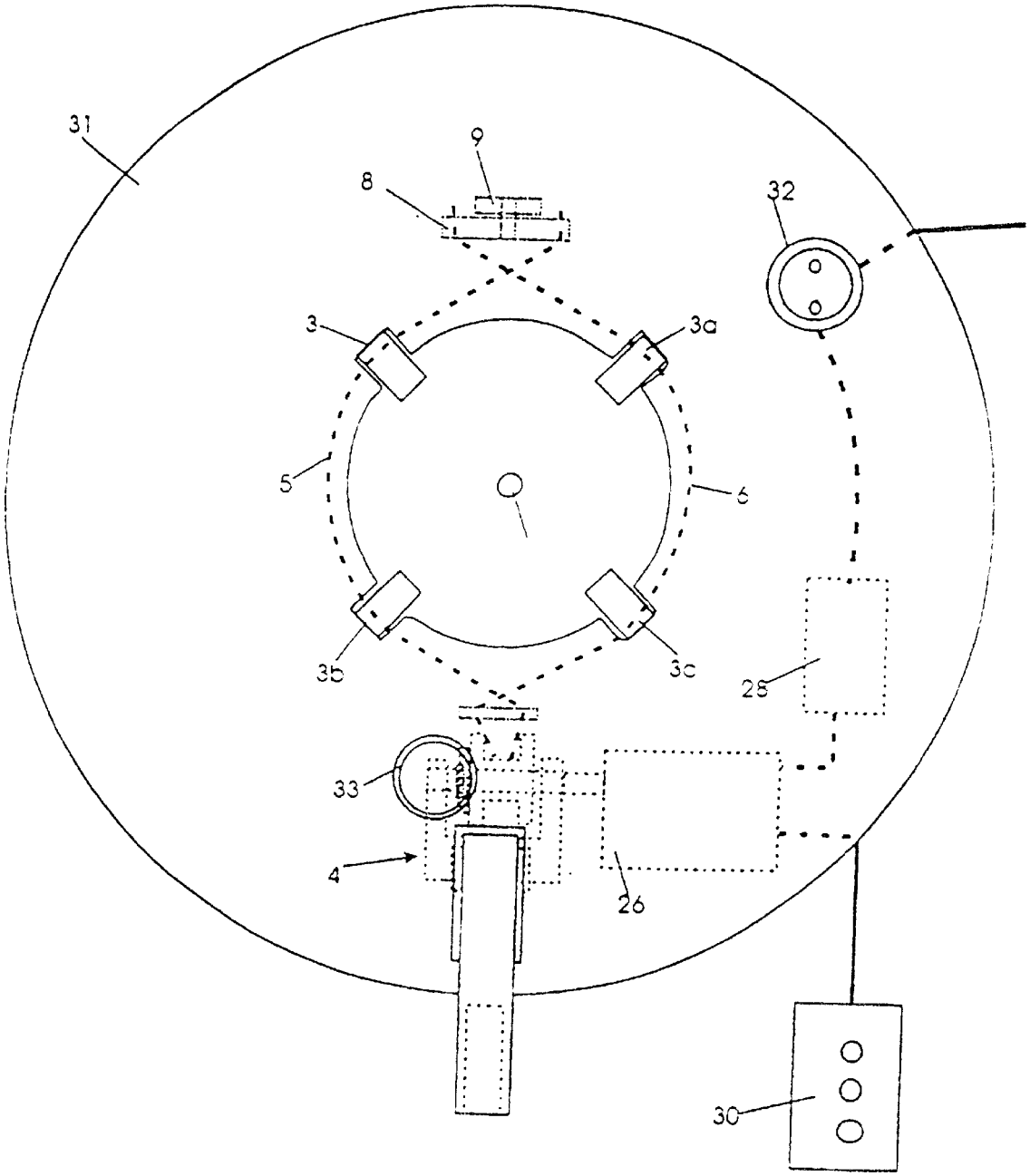
FIG. 3 is a simplified plan view with the stand closed by a cover.

In a modification to FIG. 1, FIGS. 2 and 3 provide for the operation of rolling up the flexible connections 5 and 6 to be taken over by an electric motor 26, which is supplied with power by a 12 V storage battery or transformer 28 and is controlled by a remote control means 30, via a drive shaft 27. Ratchet 18 is arranged upstream and is intended to prevent the undesired release of the flexible connections 5 and 6, and thus of the retaining elements 3, 3*a*, 3*b* and 3*c* in the event of power failure.

Providing an electrical socket 32, for example, one providing 220 V, enclosed in a water-tight manner in the cover 31 for the connection of electric Christmas tree lights results in a user friendly Christmas tree stand.

Release of ratchet lock 20*b* and 33 releases the ratchet 18 and thus the tension on the flexible connections 5 and 6. The restoring spring 7 can draw the retaining elements 3, 3*a*, 3*b* and 3*c* together, beneath their mounts 13, 13*a*, 13*b* and 13*c*, towards their axis of symmetry, with the result that the retaining elements 3, 3*a*, 3*b* and 3*c*, which retain the tree by way of their top ends, release said tree. The Christmas tree can now be removed.

What is claimed:

1. A mechanical retaining device for receiving a pole member, comprising:

retaining elements for engaging the pole member, the retaining elements being movably mounted on a base plate to move towards an axis of symmetry of the base plate;

a force transmitting elements connected to the retaining elements so as to position said retaining elements upon tensioning of the force transmitting elements;

a fastening element for anchoring first portions of said force transmitting element;

a tensioning device for engaging second portions of said force transmitting elements and tensioning the force transmitting elements such that force is applied to the retaining elements to apply force to the pole member;

a diverting element, for guiding the force transmitting elements, disposed between the retaining elements and the tensioning device; and the force transmitting elements being crossed with respect to one another between the diverting element and the retaining elements.

2. The mechanical retaining device of claim 1 wherein the force transmitting elements are crossed with respect to one another between the fastening element and the retaining elements.

3. The mechanical retaining device according to claim 1 wherein the force transmitting elements are steel cables.

4. The mechanical retaining device according to claim 1 wherein the tensioning device includes an electric motor for applying tension force.

5. A mechanical retaining device for receiving a pole member, comprising:

a base plate;

retaining elements for engaging the pole member, the retaining elements being movably mounted on the base plate to move towards an axis of symmetry of the base plate;

a force transmitting element connected to the retaining elements so as to position said retaining elements upon tensioning of the force transmitting element;

a tensioning device for tensioning the force transmitting element; and a movable fastening element disposed on the base plate and having said force transmitting element anchored thereto, said movable fastening element being movable such that different ones of said retaining elements apply differing force levels to the pole member.

6. The mechanical retaining device according to claim 5 wherein said movable fastening element is tiltable.

7. The mechanical retaining device according to claim 5 wherein said movable fastening element is rotatable.

8. The mechanical retaining device according to claim 5 wherein said movable fastening element is tiltable and is rotatable.

9. The mechanical retaining device of claim 5 further comprising a diverting element for guiding the force transmitting element is disposed between the tensioning device and the retaining elements.

10. The mechanical retaining device according to claim 5 wherein the tensioning device includes an electric motor for applying tension force.

11. A mechanical retaining device for receiving a pole member, comprising:

retaining elements for engaging the pole member, the retaining elements being movably mounted on a base plate to move towards an axis of symmetry of the base plate;

first and second force transmitting elements respectively connected to ones of the retaining elements so as to position said retaining elements upon tensioning of the force transmitting elements;

a first anchor for movably anchoring a first end of said first force transmitting element;

a second anchor for movably anchoring a first end of said second force transmitting element; and a tensioning device for engaging second end of said first and second force transmitting elements and tensioning the first and second force transmitting elements such that force is applied to the retaining elements to apply force to the pole member.

12. The mechanical retaining device of claim 11 further comprising a diverting element for guiding the first and second force transmitting elements is disposed between the tensioning device and the retaining elements.

13. The mechanical retaining device of claim 11 wherein the first and second anchors are disposed on a movable fastening element.

14. The mechanical retaining device according to claim 13 wherein said movable fastening element is tiltable.

15. The mechanical retaining device according to claim 13 wherein said movable fastening element is rotatable.

16. The mechanical retaining device according to claim 13 wherein said movable fastening element is tiltable and is rotatable.

17. The mechanical retaining device according to claim 11, wherein the first and second force transmitting elements are steel cables.

18. The mechanical retaining device according to claim 11, wherein the tensioning device includes an electric motor for applying tension force to the first and second force transmitting elements.

19. The mechanical retaining device according to claim 18, wherein the tensioning device includes a releasable ratchet device driven by the electric motor.

20. The mechanical retaining device according to claim 18, wherein the electric motor is supplied with power by a transformer.

21. The mechanical retaining device according to claim 18, wherein the electric motor is controlled by a remote control.

* * * * *